United States Patent [19]

Nowlan

[11] Patent Number: 5,005,668

[45] Date of Patent: Apr. 9, 1991

[54] LADDER STEP SUPPORT

[76] Inventor: Bud C. Nowlan, 3958 Aldrich Ave. N., Minneapolis, Minn. 55412

[21] Appl. No.: 555,898

[22] Filed: Jul. 20, 1990

[51] Int. Cl.[5] ..... E04C 7/16

[52] U.S. Cl. ..... 182/121; 248/238

[58] Field of Search ..... 182/121, 120, 122; 248/238

[56] References Cited

U.S. PATENT DOCUMENTS

| | | | |
|---|---|---|---|
| 745,750 | 12/1903 | Ziegler et al. . | |
| 1,216,214 | 2/1917 | Connell . | |
| 1,487,243 | 3/1924 | Jackson | 182/121 |
| 1,725,723 | 8/1929 | Silva . | |
| 1,920,552 | 8/1933 | Dollerhide . | |
| 2,282,133 | 5/1942 | Horton . | |
| 2,297,883 | 10/1942 | Glover . | |
| 2,439,185 | 4/1948 | Patt | 182/121 |
| 2,500,559 | 3/1950 | Miller . | |
| 2,553,322 | 5/1951 | Kurmer | 182/121 |
| 2,876,047 | 3/1959 | Plante | 182/121 |
| 3,067,836 | 12/1962 | Carnicelli | 182/121 |
| 3,294,197 | 9/1964 | Kwiatkowski . | |
| 3,511,338 | 5/1970 | Chapman . | |
| 3,899,045 | 8/1975 | Geisel | 182/121 |
| 4,085,819 | 4/1978 | Ohnstad | 182/121 |
| 4,211,307 | 7/1980 | Ethridge . | |
| 4,401,187 | 8/1983 | Van Patten . | |
| 4,482,030 | 11/1984 | Lincourt . | |
| 4,496,025 | 1/1985 | Gattman | 182/121 |
| 4,646,878 | 3/1987 | Moyer . | |
| 4,687,075 | 8/1987 | Skaggs . | |
| 4,909,351 | 3/1990 | Johnson et al. . | |

*Primary Examiner*—Reinaldo P. Machado

*Attorney, Agent, or Firm*—Grady J. Frenchick, Ltd.

[57] ABSTRACT

A substantially one-piece ladder attachment is disclosed. The attachment provides a secure, laterally well-supported platform on which a worker would stand. The invention is particularly useful for an extension ladder, especially one with circular rungs. The attachment of the invention comprises a platform having a single, hollow, vertical support member projecting from one edge thereof. The vertical support is centrally disposed on the edge on which it is located. The vertical support angularly projects from the platform and is connected to an arcuate, horizontally disposed, transversely mounted upper bracket. The upper bracket is intended to engage the rung of a ladder to impart lateral stability to the platform. The attachment further includes a lower, horizontally-disposed arcuate bracket which is securely mounted to the same edge of the platform as the vertical support. The lower bracket is intended to cooperate with a second rung of a ladder to provide lateral, as well as, vertical stability to said platform. In a preferred practice of this invention, grip means are adhered to the top of the platform. In a further preferred practice of the invention, a rung security means, such as a key, is mounted in said upper bracket and through the support member to secure the attachment to the ladder.

8 Claims, 2 Drawing Sheets

LADDER STEP SUPPORT

BACKGROUND OF THE INVENTION

I. Field of Invention

The invention relates to a one piece, portable, or removable platform attachment or step support for a ladder. More particularly, the invention is directed to a one piece, detachable perch, platform, or ladder attachment which, in a preferred practice, can easily be locked into position. This invention is particularly for use by painters and other laborers who require stable footing when working while standing on a ladder. This invention is particularly suited to the situation where the work requires the laborer to stand on a platform for extended periods of time and at varying heights above ground level during the work activity.

The invention further relates to an improved ladder rung attachment. The device, in its preferred practice, fixes a platform in a generally horizontal plane, enabling the laborer to have stable footing thereon, without any obstruction from the ladder attachment. The device can also be used to place containers or articles thereon for the laborer's use over extended periods of work activity.

The invention can be used for a variety of applications, and the method of construction of the device is more fully described herein.

2. Description of the Prior Art

Various prior art ladder attachment devices, and the like, as well as their apparatuses and the method of their construction in general, are known and are found to be exemplary of the U.S. prior art. They are:

| Inventor | U.S. Pat. No. |
|---|---|
| B. H. Ziegler and D. Betzner | 745,750 |
| C. M. Dollerhide | 1,920,552 |
| K. C. Miller | 2,500,559 |
| E H. Chapman | 3,511,338 |
| W. R. Lincourt | 4,482,030 |
| R. J. Kwiatkowski | 3,294,197 |
| R. Moyer | 4,646,878 |
| C. E. Van Patten | 4,401,187 |
| F. W. Ethridge | 4,211,307 |
| W. J. Carnicelli | 3,067,836 |
| J. J. Glover | 2,297,883 |
| K. W. Horton | 2,282,133 |
| A. A. Silva | 1,725,723 |
| W. J. Connell | 1,216,214 |
| C. E. Johnson | 4,909,351 |
| J. W. Skaggs | 4,687,075 |

The Lincourt patent is for a safety platform which has L-shaped hooks used for attachment to the upper and lower rungs. Dollerhide shows a detachable ladder step secured to two rungs of the ladder; U-shaped hooks are used for securing the invention to the upper rung. Chapman's invention also utilizes U-shaped brackets, but uses them to secure the device to the lower rung; steel hooks secure the stand to the upper rung.

The Miller patent is directed to a ladder platform wherein the base is pivotably secured to one rung and swinging hook means are adjustable to various positions by means of notched formations in the side flanges of the platform.

The Ziegler and Betzner patent disclose an extension ladder with a moveable and adjustable shelf which is also secured in place by hooks projecting from the shelf to two rungs of the ladder. The extension feature of the ladder employs a bracing mechanism.

The Kwiatkowski patent discloses a perch for a ladder that sits upon one rung and has a cross member which engages the vertical support arms.

The Moyer patent discloses a portable ladder step having a portable attachment means having and a leveling means connected to the attachment means and the platform.

The Van Patten patent discloses a ladder platform accessory using resilient bracket arms in a hinged connection to the platform.

The Ethridge patent discloses a removable step for a ladder which permits the shelf or platform to be pivoted inward and outward so as not to obstruct normal use.

The U.S. Pat. to Carnicelli is an adjustable step, for ladders utilizing two side members which contact the ladder rungs. The patents to Glover, Horton, Skaggs and Silva are variations on the type of construction of Carnicelli. The patent to Connell also is of analogous construction to that of Carnicelli.

The Johnson patent discloses a platform attachment for ladder having a retracted and a working position.

These patents or known prior uses teach and disclose various types of ladders and ladder attachment devices of sorts and of various manufacturers, and the like multiple piece ladder jacks and stabilizers, as well as methods of their construction. None of these references or other known devices, whether taken singly or in combination, disclose or suggest the specific details of the present invention, as claimed.

OBJECTS OF THE INVENTION

An object, advantage, and feature of the invention is to provide a novel, one-piece, portable or removable ladder attachment that is safe and efficient in use, providing its user with a stable platform fixed at a generally horizontal plane for placement of containers or like articles, or, more especially, for use as a platform to stand upon while working at heights above ground level.

In a preferred practice of the invention, it is directed further to a device providing for the easy locking of the attachment device into a desired position on the rungs of a ladder, and the easy removal thereof, without tools or complicated mechanical measures. In one practice of this invention, height adjustment can be accomplished while the user is standing on the ladder above ground level. This is a substantial improvement over existing devices whereby various types of hook assemblies or other means are utilized to suspend the ladder attachment on the ladder rungs.

Another object of the invention is to provide a novel and improved construction of securing a ladder attachment.

Another object of the invention is to provide a novel and improved method of construction of a ladder attachment whereby a locking mechanism is incorporated therein, allowing for the required stability essential for supporting a person at heights above ground level, and enabling said person to remove and reengate the attachment to different rungs of the ladder if needed to perform the desired work activity, e.g., at a different height above ground.

These, together with other objects and advantages of the invention, reside in the Detailed Description of the Invention, as is more fully hereinafter described and claimed.

Briefly, in one aspect, the present invention is a one-piece ladder attachment. The attachment provides a secure, laterally well-supported platform on which a worker would stand. It permits easy adjustment of the vertical distance the platform is located above the ground. The invention is particularly useful for an extension ladder, especially one with circular rungs. The attachment of the invention comprises a platform having a single, hollow, vertical support member projecting from one edge thereof. The vertical support is centrally disposed on the edge on which it is located. The vertical support angularly projects from the platform and is connected to an arcuate, horizontally disposed, transversely mounted upper bracket. The upper bracket is intended to engage the rung of a ladder to impart lateral stability to the platform. The attachment further includes a lower, horizontally-disposed, arcuate bracket which is securely mounted to the same edge of the platform as the vertical support. The lower bracket is intended to cooperate with a second rung of a ladder to provide lateral, as well as, vertical stability to said platform. In a preferred practice of this invention, grip means are adhered to the top of the platform. In a further preferred practice of the invention, a rung security means, such as a key or pin, is mounted in said upper bracket and through the support member to secure the attachment to the ladder.

In utilization, the invention is carried to the work site, is attached to the rungs of a ladder with the platform at the desired height. The worker then climbs the ladder. The minimal projection of the platform from the plane of the ladder permits the ladder to be climbed with minimal interference by the attachment. The height above ground of the platform then can be easily and quickly changed to provide a comfortable, safe and convenient place for the worker to stand or to place equipment.

DETAILED DESCRIPTION OF THE INVENTION

Figure 1:
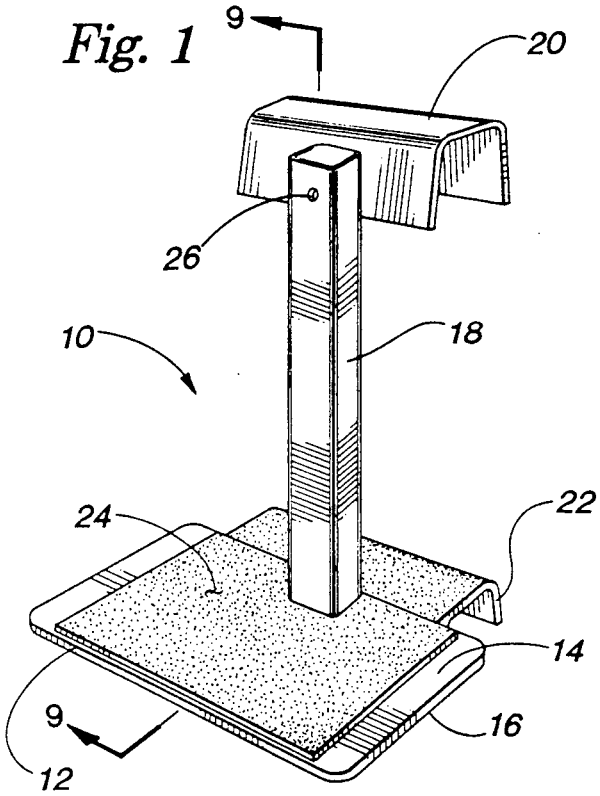
FIG. 1 is a perspective view of an apparatus or attachment of the present invention.
Figure 4:
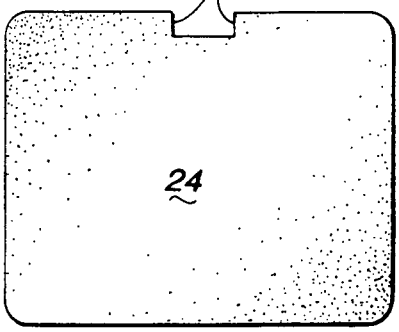
FIG. 4 is a plan view of the safety grip as shown in FIG. 1.
Figure 5:
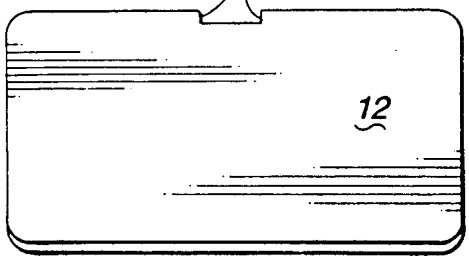
FIG. 5 is the step plate of the invention shown in FIG. 1.

Reference is now made to the attached figures wherein like numerals are used to refer to like features of the invention in various views. FIG. 1 is a perspective view of a ladder attachment 10 of the invention. Ladder attachment 10 comprises a rectangular platform 12 having a top 14 and a bottom 16. Rectangular platform 12 has substantially parallel long edges and short edges. One of the long edges would be placed substantially adjacent to the plane of a ladder on which the instant attachment is to be employed. The same edge has a lip or notch 13 therein. Attachment 10 further includes a single, centrally disposed, angularly rigid L-shaped (in cross-section) vertical support member or spine 18 which is described in more detail below. Lastly, attachment 10 includes an upper rung bracket 20 and lower rung bracket 22 which also are described in more detail below. As shown in FIG. 1, plate 12 has an optional safety grip or tread 24. The general configuration of safety grip or tread 24, such as would be placed on the top 14 of platform 12, is shown in the plan view in FIG. 4. Tread 24 has a notch or cut-out 25 which permits support 18 to pass therethrough. Lastly, an optional securement means such as, for example, a safety pin 26 is shown passing through the upper portion of support member 18 and through upper bracket 20. This is most clearly shown in FIG. 9, below.

Figure 2:
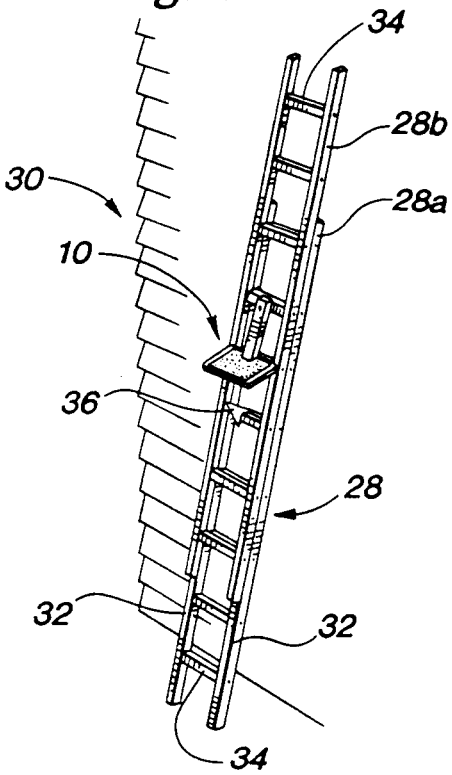
FIG. 2 is a perspective view of an apparatus of the present invention as it would be deployed on a ladder leaning against a building.

FIG. 2 shows an attachment of the present invention as it would appear if placed on a ladder 28 leaning against a building or house 30. Ladder 28 comprises two vertical supports or rails 32 and a plurality of horizontal supports, or rungs 34. Vertical supports 32 and rungs 34 generally define the plane of the ladder which, as shown, is angularly disposed with respect to building 30. The ladder shown in FIG. 2 is a particular variety of ladder, namely, an extension ladder. Ladder 28, therefore, comprises two segments 28a, 28b which are attached to each other by extension ladder lock 36. The present invention is preferably used with an extension ladder, but is more preferably used with any variety of ladder that has circular rungs.

In its preferred utilization, the plane of ladder 38 is approximately 70 degrees with respect to the vertical plane of the building 30. In this manner, optimum reach of the ladder is obtained whereas uniform distribution of the weight of a worker on the ladder is permitted. In a preferred practice of the invention, an aluminum extension ladder is employed in conjunction with this invention.

Figure 3:
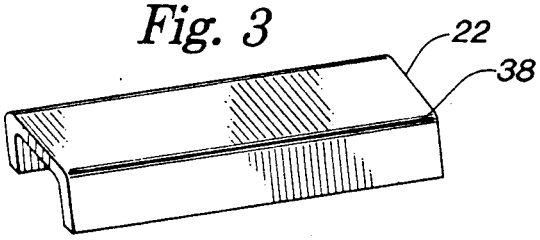
FIG. 3 is a lower bracket assembly for the invention as depicted in 1.

FIG. 3 depicts a perspective view of lower rung bracket 22. Lower bracket 22 is generally hemispherical or semi-circular in cross-section and may be referred to as "C-shaped". The precise cross-sectional shape of bracket 22 is not particularly important as long as it is sufficiently arcuate so as to cooperate with ladder rungs 34 so as to provide stability to platform 12. (A similar limitation applys to upper rung bracket 20 which is more clearly shown in FIG. 12.) The dotted bead or bend 38 of bracket 22 is generally the region in which it would be attached to the long edge of platform 12, which has lip 13 in it. Lower bracket 22 would be aggressively attached to platform 12 adjacent the edge having lip 13, such as for example, by welding. Lip 13 provides the opening through which a portion of vertical support member 18 projects. The extended portion of support member 18 which projects through lip 13 is then attached to the bottom 16 of platform 12.

Figure 6:
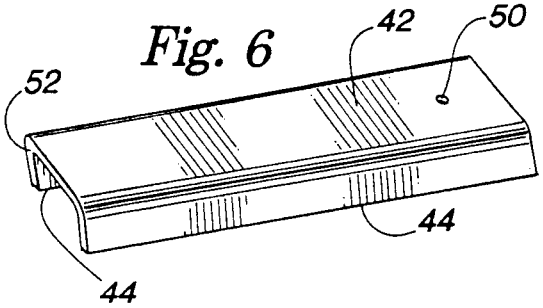
FIG. 6 is the spine stiffener of the invention shown in FIG. 1.
Figure 7:
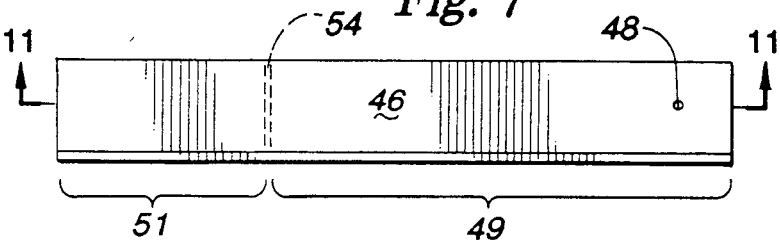
FIG. 7 is the L-shaped back member of the vertical support member shown in FIG. 1.

FIGS. 6 and 7 illustrate the two pieces which are integrally secured to create vertical support member 18. FIG. 6 depicts the arcuate, "U" or "C" shaped vertical support stiffener 42 whose long edges 44 would be, for example, welded to the oblique-angled, spine or support back member 46 shown (on its side) in FIG. 7. Back member 46 is shown in cross-section in FIG. 11. Back member 46 comprises a longer segment or leg 49 which bends (at 54) into a shorter segment or leg 51. Stiffener 42 would be approximately the same length as back member longer segment 49. The length of this portion of the invention would be determined by the vertical separation of ladder rungs. Generally, the stiffener 42 would be about twelve inches in length. Back member hole 48 would be lined up with vertical support stiffener hole 50 so as to permit a safety means, e.g., a screw and nut, (described below) passed therethrough. In actual construction of the attachment, arcuate edge 52 would be welded to the top 14 of platform 12. FIG. 7 is a plan view of back member 46, the dotted bead or bend 54 indicating where the shorter leg 51 of back member 46 would angle into the plane of this paper.

Figure 8:
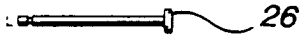
FIG. 8 is a side view of a safety pin which could be employed in the present invention to secure it to a ladder rung.

FIG. 8 depicts an optional safety pin 26 for the present attachment. Safety pin 56 could be a nut and screw arrangement. Alternatively, a spring-loaded mechanism could be attached to support member 18 so as to keep safety pin 26 permanently mounted thereon. In yet another embodiment, safety pin 26 could be connected to attachment 10, e.g., by means of a chain. Various other rung securement means could be used.

Figure 9:
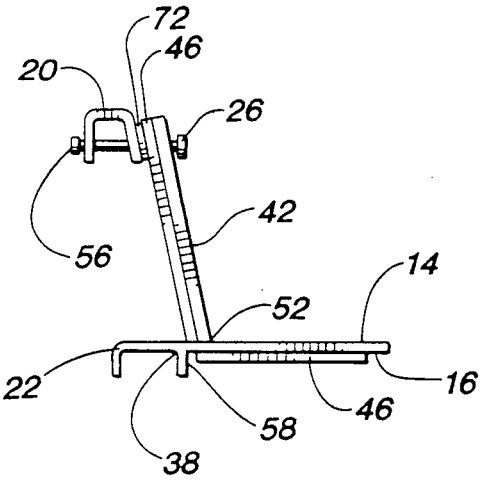
FIG. 9 is a sectional side view of the invention taken along line 9—9 in FIG. 1.

As shown in FIG. 9, safety pin 26 passes through vertical support member 42 through back member 46 and continues on through upper bracket 22. Safety pin 26 passes through the above referenced holes in various components. A nut 56 can be attached to the end of safety pin 26 so as to prevent attachment 10 from detaching from ladder rung on which it is placed. Bead or bend 38 is the region of lower bracket 22 which is welded to the lip edge of platform 12 (at 58). Further, the arcuate edge 52 of vertical support stiffener 42 would be secured (e.g., welded) to the top 14 of rectangular platform 12. In this manner, vertical support member 18 provides angularly stable, lateral and transverse support to rectangular platform 12 when the device is placed upon ladder rungs. When the optional safety pin is used conjunction with safety pin nut 56 to place attachment 10 on two rungs 34 of a ladder 28, a very stable and secure, substantially horizontal standing area (e.g., on optional tread 24) is provided.

Figure 10:
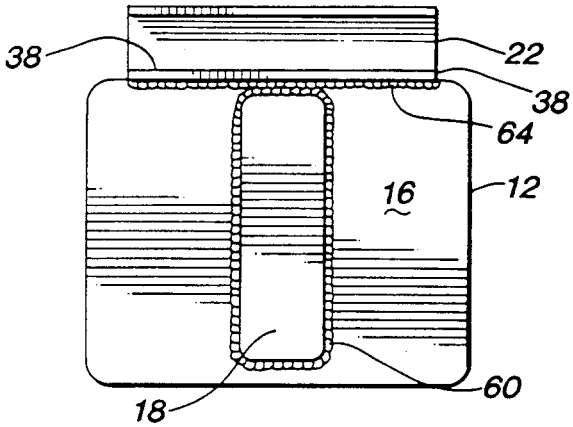
FIG. 10 is a bottom plan view of the invention shown in FIG. 1.

FIG. 10 shows a bottom plan view of attachment 10. The bottom 16 of platform 12 is shown to be welded by (bead 60) to the top 62 of support member 18. Lower bracket 22 is also shown to be welded to the lip edge of rectangular platform 12 by edge bead 64. Surprising and unexpected dimensional stability for the attachment is provided by this arrangement.

Figure 11:
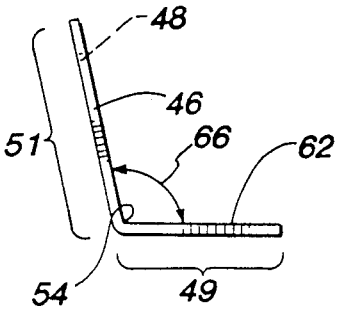
FIG. 11 is a section side view of a component of the attachment taken along line 11 of FIG. 6.

FIG. 11 shows, in section, back member 46 of FIG. 6. Arrows 66 generally indicate the angle that L-shaped vertical back member 18 maintains. For example, the angle between the back member long portion or leg 49, and the short portion or leg 51, of backing member 46 depicted in FIG. 11 would fall in the range of 10 to 20 degrees from a right angle. One skilled in this art will recognize that assuming platform 12 is to be substantially horizontal the angle subtended by arrow 66 will be determined by the preferred angle between the vertical face of the building 30 against which ladder 28 is leaning.

Figure 12:
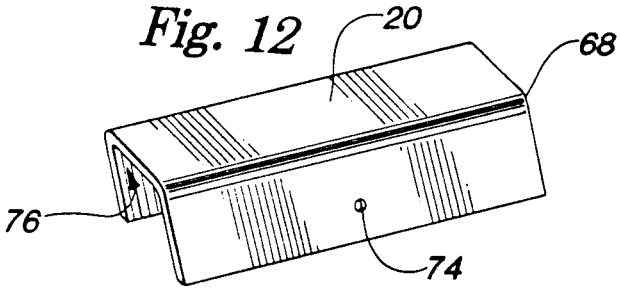
FIG. 12 is an upper bracket of the invention shown in FIG. 1.

FIG. 12 shows upper bracket 20 along with its bead or bend 68. Upper bracket bead or bend 68 will delineate upper bracket face 70 to which L-shaped support member 18 will be secured, e.g., by weld 72. Upper bracket hole 74 permits pin 26 to pass therethrough. Arrow 76 indicates the angle subtended by the ladder-side of upper bracket 20. In a preferred practice, the angle defined by arrow 76 is approximately 90 degrees. Other angles may be employed, if desired provided upper bracket 20 is substantially arcuate.

The dimensions of the attachment of the present invention are determined by the normal separation distance between the rungs of a ladder. Moreover, rectangular platform 12 would, of necessity, be narrower than the vertical separation of supports or rails 32. A typical size for platform 12 would be six inches by twelve inches. A preferred material from which the present attachment is made is aluminum. Generally, aluminum stock having a thickness of one-eighth inch (for, e.g., the brackets) to three-sixteenths inch (for the stiffeners) is employed. Surprisingly an attachment of this invention has been found capable of supporting a worker on a ladder where the worker weight is three hundred to five hundred pounds.

In a typical practice of this invention, the worker places the ladder 28 against building 30. He/she then decides the height at which the worker wishes to have his/her feet. The one-piece, light-weight aspect of this invention permits the worker to carry the attachment to the ladder, attach it to the ladder at the requisite height, and then climb the ladder until the workers feet are thereon. The worker may then work comfortably for many hours while standing on platform 12.

Many variations and alterations of the above invention will become readily obvious to one of ordinary skill in the art in view of the above disclosure. These alterations and variations are intended to be within the scope of the attached claims.

The dimension of the article and the single central, vertical support, then permit the worker to demount from the ladder without substantial interference from the platform.

What is claimed is as follows:

1. A portable, integral ladder rung attachment comprising:

a substantially rectangular platform, having a top and a bottom and a lip in a long edge thereof, the platform having securely attached on its bottom and its lip;

an elongate, oblique-angled, L-shaped, centrally disposed vertical support member, the support member having a tubular longer leg projecting from said platform and leading to a substantially flat shorter leg, the shorter leg being attached to the bottom of the platform, the opening of the tubular portion of the support being attached to the top of the platform adjacent its lip, the attachment further comprising;

horizontally mounted, elongate, arcuate, upper and lower brackets for cooperation with ladder rungs to support the platform, the upper bracket being secured transversely adjacent the end of the tubular long leg of said vertical support and the lower bracket being secured to the lip edge of said platform.

2. The attachment of claim 1 which further comprises a securement means.

3. The attachment of claim 2 wherein the securement means is a pin.

4. The attachment of claim 1 which further comprises a safety grip located on the top of the platform.

5. A portable, removable, substantially one piece ladder attachment comprising:

a platform having a top and a bottom, a long and a short dimension, the platform having attached, along a long dimension thereof;

a hollow, vertical support, the support angularly projecting from the edge of said platform and being aggressively secured to said platform so as to maintain said angle, the support being connected, on its distal end to an arcuate, horizontally disposed and transversely mounted upper bracket, the bracket being adapted so as to hang on and cooperate with a first rung of a ladder; the platform further comprising a lower, arcuate, horizontally disposed bracket, said lower bracket being affixed to said platform along the same edge as the support and being adapted to be placed over a second rung of a ladder to provide lateral stability to said platform.

6. An attachment according to claim 5 which further comprises rung securement means in said upper bracket.

7. An attachment according to claim 6 wherein said securement means is a safety pin which projects through said support and said upper bracket to transversely engage a ladder rung.

8. An attachment according to claim 5 which further comprises a safety grip adhered to the top of said platform.

* * * * *